United States Patent [19]

Marlin

[11] 4,153,421

[45] May 8, 1979

[54] STABILIZED FUEL SLURRY

[75] Inventor: Louis A. Marlin, Crestwood, Ill.

[73] Assignee: Interlake, Inc., Chicago, Ill.

[21] Appl. No.: 687,146

[22] Filed: May 17, 1976

[51] Int. Cl.[2] ..... C10L 1/32

[52] U.S. Cl. ..... 44/51

[58] Field of Search ..... 44/51; 252/312

[56] References Cited

U.S. PATENT DOCUMENTS

| | | | |
|---|---|---|---|
| 1,390,232 | 9/1921 | Bates | 44/51 |
| 1,390,233 | 9/1921 | Bates | 44/51 |
| 2,090,393 | 8/1937 | Roberts | 44/51 |
| 2,118,477 | 5/1938 | Roberts | 44/51 X |
| 2,423,913 | 7/1947 | Vose | 44/51 |
| 3,210,168 | 10/1965 | Morway | 44/51 |
| 3,359,040 | 12/1967 | Every et al. | 44/51 X |
| 3,617,095 | 11/1971 | Lissant | 44/51 X |
| 3,732,084 | 5/1973 | Nixon et al. | 44/51 |
| 3,907,134 | 9/1975 | Metzger | 44/51 |
| 4,030,894 | 6/1977 | Marlin et al. | 44/51 |

*Primary Examiner*—Thomas Waltz

*Attorney, Agent, or Firm*—Vogel, Dithmar, Stotland, Stratman & Levy

[57] ABSTRACT

A method of preparing a stabilized fuel slurry is disclosed wherein a petroleum fuel oil is mixed with "run of the mine" coal and with a polysaccharide emulsifier capable of forming water internal-oil high external phase emulsion. The slurry is mechanically mixed to comminute the coal to produce a stabilized fuel slurry with coal particles having diameters as large as about ¼ inch. The slurry is injected through lances into a blast furnace, the lances provided concentric streams of slurry and steam. The slurry may also be used in other fuel burning furnaces such as boilers, cement kilns, etc.

11 Claims, No Drawings

STABILIZED FUEL SLURRY

BACKGROUND OF THE INVENTION

Suspensions of coal and coal by-products in fuel oil have been proposed as a fuel for blast furnaces, boilers and other fuel burning devices, but because of the danger and difficulty in handling and maintaining the suspensions over long periods of time, no practical system has yet been devised for the large scale use of this combination fuel. Methods have been proposed such as those in co-pending application Ser. No. 591,312, filed June 30, 1975, now U.S. Pat. No. 4,030,894, but even those methods require the use of an expensive emulsifier, which severely reduces the economic benefits of the system.

U.S. Pat. No. 2,118,447, issued May 24, 1938 to Roberts teaches the combination of colloidal coil particles and oil to form a suspension for use as a composite fuel. The difficulty and expense in grinding coal to colloidal fineness, such that it passes through a 300 to 1,000 mesh sieve has prevented the composition fuel disclosed by Roberts from being used in present day furnaces.

U.S. Pat. No. 2,231,513, issued Feb. 11, 1943 to Stillman, teaches a stable suspension of coal and oil made by pre-grinding coal particles until they pass through a 100-mesh screen and thereafter introducing the pre-ground particles into oil and subjecting the combination to a further grinding until the particle size is reduced to about 5 microns. All of the coal particles are small enough to pass through a 325-mesh screen, and at least 50% of the particles are under 10 microns in size, which is sufficient for the particles to produce the phenomenon known as the "Brownian Movement." The "Brownian Movement" of the particles is sufficient to maintain all of the coal particles in stable suspension, in lieu of starch, since starch forms a "gel" with a disadvantageously high viscosity making preheating and pumping the slurry difficult.

Other patents, such as the Plauson et al. U.S. Pat. No. 1,647,471, issued Nov. 1, 1927, teach the combination of pre-ground carbonaceous material with an oil. The Plauson et al. patent teaches pre-grinding the carbonaceous material to a powder which passes through a 125 to 250 mesh screen, and thereafter, forming an emulsion with the oil by the addition of from about 1% to about 3% of a soap solution. The Plauson et al. patent has an additional disadvantage besides the small particle size of the carbonaceous material as the suspension or emulsion is produced in small batches using a cross hammer mill rotating at 325 feet per minute.

U.S. Pat. No. 2,090,393 issued Aug. 17, 1937 to A. A. Roberts, teaches the use of a minor amount of starch in the order of 150 of 1%, mixed with water and an electrolyte such as a boron compound. The fundamental thrust of the patent is to improve combustion, not to produce a slurry stable for several weeks. The specific problems to which the present invention is directed are not discussed in the Roberts patent.

U.S. Pat. No. 2,423,913, issued to Vose, like the Stillman patent, specifically teaches away from the use of a starch to stabilize an emulsion of the subject type, since starch often causes a thixotropic "gel" which is hard to preheat and pump.

All of the above referred to patents teach combination liquid and solid fuels, which are difficult or dangerous to produce, and none of the references teaches a method of producing a slurry stable over a period of several weeks, thereby ensuring that lines temporarily shut down will not have the slurry separate and solidify, resulting in excessive cost and down time. Particularly, any method which requires that the coal be ground in the dry state presents a potential explosive hazard and should be avoided. Processes in which coal is colloidal in size require grinding times in excess of five or six hours, making the process uneconomical. Processes which use expensive or hard to obtain emulsifiers are uneconomical or so burdensome as to be useless. Processes which produce a slurry difficult to pump or a slurry with a tendency to settle after a few days, are simply commercially not useful. These and other disadvantages are obviated by the present invention using an inexpensive emulsifier to produce an extremely stable slurry, thereby permitting extensive industrial use of the present invention.

SUMMARY OF THE INVENTION

This invention relates to a method of preparing a stabilized fuel slurry and more particularly to a method of preparing a stabilized fuel slurry in which solid fuel particles are comminuted in liquid fuel oil with certain inexpensive polysaccharides to produce a very stable fuel slurry having solid fuel particles with diameters as large as about one-quarter inch and capable of being stored in line for as long as many weeks without solidifying and clogging the lines.

It is a principal object of the present invention to provide a stable fuel slurry over long periods of time from "direct shipping coal" or "run of the mine" coal wherein the slurry contains solid fuel particles with diameters as large as about one-quarter inch and is stabilized by certain relatively inexpensive polysaccharides.

Another object of the present invention is to provide a stabilized fuel slurry for injection into blast furnaces preferably with steam atomization.

Another object of the present invention is to provide a stabilized fuel slurry for burning in boilers which may be integrated in a common fuel supply system with blast furnaces or they may be completely separate. Use of the stabilized fuel slurry, however, is not limited to use in blast furnaces or boilers but may be utilized in other fuel burning devices.

Yet another object of the present invention is to provide a method of producing a stabilized fuel slurry of a water internal-oil high external phase emulsion including an emulsifier selected from certain polysaccharides capable of forming said emulsion and present in the range of from about 0.1% by weight to about 10% by weight of the slurry, water present in the range of from about 1% by weight to about 30% by weight of the slurry, liquid fuel oil present in the range of from about 30% by weight to about 70% by weight of the slurry, and solid fuel particles with diameters as large as about ¼ inch dispersed in the emulsion and present in the range of from about 25% by weight to about 65% by weight of the slurry to form a slurry stable for a period of time in excess of one month.

Still another object of the present invention is to provide a method of preparing the stabilized slurry set forth above including the steps of providing a liquid fuel oil, adding an emulsifier of polysaccharides selected from the class consisting of dextrin, modified starch and modified cellulose, and water to the liquid fuel oil, adding solid fuel particles with diameters as large as about 2 inches to the mixture of liquid fuel oil and emulsifier and water, and agitating the solid fuel particles in the liquid medium to form a water internal-oil high external phase emulsion and a stabilized fuel slurry having solid fuel particles with diameters as large as about ¼ inch, which slurry remains stable for a period of time in excess of one month.

A further object of the present invention is to provide a method of the type set forth in which the water internal-oil high external phase emulsion is formed before the solid fuel particles are added.

DESCRIPTION OF THE PREFERRED EMBODIMENTS

The combination fuel of the present invention includes a liquid fuel oil which preferably is a petroleum product or coal product and includes crank case oil, crude oil, various fuel oils such as No. 6 fuel oil, raw coal tar and any other type of combustible oil. The combination fuel of the present invention also includes a solid fuel which may be any carbonaceous fuel such as coal, coke breeze, petroleum coke or residuum or any other solid combustible material.

The emulsifiers used in the combination fuel to provide a stabilized slurry are certain polysaccharides with dextrin being preferred and other useful polysaccharides being modified starches such as a pregelatinized corn starch or a hydrolyzed starch-polyacrylonitrile graph copolymer as well as modified cellulose such as methyl cellulose.

As used herein the term "modified starch" means a starch such as pregelatinized corn starch or a hydrolyzed starch-polyacrylonitrile graft copolymer which when mixed with oil, water and lump solids, such as coal, forms a water internal-oil high external phase emulsion and slurry substantially stable for a period of time in excess of one month. Some settling may occur but the slurry must remain pumpable without prolonged agitation to be useful.

As used herein, the term "modified cellulose" means a cellulose such as methyl cellulose which when mixed with oil, water and lump solids, such as coal, forms a water internal-oil high external phase emulsion and slurry substantially stable for a period of time in excess of one month. Some settling may occur, but the slurry must remain pumpable without prolonged agitation to be useful.

It is recognized that dextrin is a modified starch and in fact is prepared by the complete hydrolysis of starch with dilute acids or by heating dry starch. Dextrin is generally colloidal in properties and describes a class of substances, thereby having no specific formula. Various commercially available dextrins may be used and the term as used in this application applies to commercially available dextrin.

The term "polysaccharides" used in the present application is generic to starch and cellulose, and while no claim is made herein that all polysaccharides are applicable, the term is used to denote the type of material with which this invention is concerned. Methyl cellulose is a modified cellulose which is greyish white and generally a fibrous powder. In aqueous suspensions it is neutral to litmus and swells to produce a clear to opalescent, viscous colloidal solution.

As used in this application, the hydrolyzed starch-polyacrylonitrile graft copolymer is produced by hydration of films from the potassium salt of the copolymer. The material is a highly absorbent starch based polymer and is described in a paper by M. O. Weaver, E. B. Bagley, J. F. Fante and W. M. Doane appearing in *Applied Polymer Symposium,* No. 25, 97–102 (1974); John Wiley Sons & Inc. A paper describing the polymer was given at the International Nonwovens and Disposable Association, meeting in Washington, D.C., on March 5 and 6, 1974, and is available from the United States Department of Agriculture, Northern Regional Research Laboratory, Agricultural Research Service, Peoria, Ill. 61604.

In general, the slurry fuels of the present invention are produced in batch operations wherein the liquid fuel oil is mixed with water and the emulsifier to form water internal-oil high external phase emulsion. Then, "run of the mine" coal or other solid carbonaceous fuel is added. A blade is driven at a high rotational speed simultaneously to disperse and to comminute the coal into particles having diameters less than about ¼ inch. The resulting slurry is stabilized such that storage over relatively long periods of time such as a month or more, results in little separation of the oil and the solid particles dispersed therein or of the water.

The stabilized slurry is not thixotropic and is pumpable as a normal liquid, the limitation in solid particle size being determined by the pumping apparatus. The stabilized slurry is then introduced into a blast furnace, preferably with steam, or may be introduced into any direct fired heater, furnace or boiler.

The advantages of the present invention reside in the use of an inexpensive emulsifier as well as the use of "run of the mine" coal without pre-grinding or drying. The use of the polysaccharides described herein produce a stabilized slurry storable for periods of time in excess of a month while increasing fuel cost very little. The terms "run of the mine" and "direct shipping" refer to coal received from the mine without further treatment by the purchaser. Since dry coil is not pre-ground, pollutive dust and the concomitant explosive problems are obviated. As the resulting slurry is stable, substantial amounts of water do not separate therefrom, thereby permitting direct injection of the slurry into the blast furnaces without remixing. Further, and of paramount importance, if a line is down for several days due to planned or unforeseen circumstances, the slurry does not settle out and clog the entire line, a condition which if it occurred would be most costly in both time and money. The dispersion of the stabilized slurry in the blast furnace is as good as a simple liquid fuel.

EXAMPLE I

A laboratory size oster blender was charged with 225 Grams of a No. 6 fuel oil at a temperature of 200° F. 25 grams of a 10% by weight solution of dextrin in water was added and the blender run for one minute to form an oil external-water low internal phase emulsion. Elsewhere herein, the emulsions formed will be classified as water internal-oil high external phase, but the different nomenclature refers to the same emulsion. 250 Grams of Illinois Old Ben Coal (with particles no greater than ¼ inch due to the blender size) was added to the emulsion and the blender was run for another ten minutes. The slurry thus formed was placed in a metal can and sealed, and thereafter heated in an oven to a temperature of 150° F. to maintain reduced viscosity and to promote settling. After 26 days no settling was apparent and only minor settling was noticable after 54 days.

The No. 6 fuel oil used had an API specific gravity of 11.5, a SSF viscosity at 122° F. of 254, a sulfur content of 0.85% by weight, an ash content of 0.034% by weight and a rating of 150,750 BTU per gallon.

The coal was Illinois Old Ben #21 from Illinois seam #6, high volatile metallurgical coal with a moisture content of 9.6% by weight, volatile content of 37.24% by weight (dry basis), ash content of 6.44% by weight (dry basis), sulfur content of 1.6% by weight (dry basis) and a fixed carbon content of 56.32% by weight (dry basis). All the coal passed through a 2 inch mesh screen.

In large scale use, the emulsifier, water and oil will first be mixed to form the proper emulsion and thereafter "run of the mine" coal, having particles as large as 2 inches will be introduced into the liquid medium and mechanically agitated by rotating blades to comminute the coal to particles of less than about ¼ inch and simultaneously form the stabilized slurry. Mixing times are on the order of ten to thirty minutes to form the slurry and on the order of one or two minutes to form the emulsion.

EXAMPLE II

A laboratory size oster blender was charged with 225 grams of a No. 6 fuel oil at a temperature of 200° F. 25 Grams of a 10% by weight solution of a pregelatinized corn starch was added and the blender run for one minute to form an oil external-water low internal phase emulsion. 250 Grams of Illinois Old Ben Coal (with particles no greater than ¼ inch due to the blender size) was added to the emulsion and the blender was run for another ten minutes. The slurry thus formed was placed in a metal can and sealed and thereafter heated in an oven to a temperature of 150° F. to maintain reduced viscosity and to promote settling. After 4 days no settling was apparent and only minor settling was noticeable after 8 days. The fuel oil and coal was the same as in EXAMPLE I.

EXAMPLE III

A laboratory size oster blender was charged with 225 grams of a No. 6 fuel oil at a temperature of 200° F. 25 Grams of a 3.3% by weight solution of a hydrolyzed starch-polyacrylonitrile graft copolymer was added and the blender run for one minute to form an oil external-water low internal phase emulsion. 250 Grams of Illinois Old Ben Coal (with particles no greater than ¼ inch due to the blender size) was added to the emulsion and the blender was run for another ten minutes. The slurry thus formed was placed in a metal can and sealed and thereafter heated in an oven to a temperature of 150° F. to maintain reduced viscosity and to promote settling. After 6 days no settling was apparent and only minor settling was noticeable after 19 days. The fuel oil and coal were the same as in EXAMPLE I.

EXAMPLE IV

A laboratory size oster blender was charged with 225 grams of a No. 6 fuel oil at a temperature of 200° F. 25 Grams of a 5% by weight solution of methyl cellulose in water was added and the blender run for one minute to form an oil external-water low internal phase emulsion. 250 Grams of Illinois Old Ben Coal (with particles no greater than ¼ inch due to the blender size) was added to the emulsion and the blender was run for another ten minutes. The slurry thus formed was placed in a metal can and sealed and thereafter heated in an oven to a temperature of 150° F. to maintain reduced viscosity and to promote settling. After a period of 6 days no settling was apparent and only minor settling was noticeable after 35 days. The fuel oil and coal were the same as in EXAMPLE I.

A screen analysis was obtained for the slurry thus prepared in which the following numbers represent the cumulative percent by weight of coal which remains on the identified screen.

8 mesh — 0.29%
12 mesh — 3.26%
25 mesh — 31.5%
35 mesh — 45.5%
70 mesh — 80.0%
100 mesh — 89.9%
140 mesh — 95.5%
200 mesh — 99.9%

In the process of the present invention, it is preferred to continue mixing the emulsion and coal dispersion until the maximum diameter of coal particles remaining is ⅛", with finer particles being present. It is apparent from the above screen analysis, that the majority of the particles are much finer than ⅛" in diameter. The fuel has better burning qualities if the particles are ground to smaller particle size; however, it is clear from the foregoing description that the colloidal size of the prior art is not necessary to the successful use of the slurry of the present invention as a fuel.

In all of the above examples, the temperature of the mixture in the disperser was maintained at 150° F. or 200° F., but stabilized slurries have been prepared with the temperature being as low as about 100° F.; however; this entails a longer mixing time in order to get the desired stability. Accordingly, while temperatures may be as low as 100° F., it is preferred that temperatures of the mixture be maintained at about 150° F. during the preparation of the stabilized slurry. After the stabilized slurry has been prepared, the mixture is allowed to cool and is generally reheated prior to injection into a blast furnace. Temperatures higher than 150° F. can be used but are more expensive. Low viscosity fuels, such as waste crank case oil, can be used at room temperature.

The fuel oil used may be present in an amount from as low as 30% by weight of the final slurry to as much as 70% by weight of the final slurry, the greater amount of solid fuel being present, the cheaper the fuel and hence the more desirable the slurry. If less than 30 weight percent fuel oil is used, the slurry is too difficult to pump. The various liquid fuel oils useful in the present invention are, No. 6 fuel oil, waste crank case oil and raw coal tar. Clearly, other fuel oils such as kerosene and the like may be used, but they are more expensive and hence undesirable.

The solid fuels useful in making up the stabilized slurries of the present invention may be selected from carbonaceous materials such as "run of the mine" coal, coke breeze, petroleum coke or residuum. Asphalt is also acceptable since it is a weak solid and readily disintegrates with mechanical mixing.

With respect to the relationship between the mixing temperature and the mixing time, the higher the temperature, the lower the viscosity of the liquid fuel oil and hence the easier the mixing. Conversely, the lower the temperature, the higher the viscosity and the more difficult the mixing is and hence a longer mixing time is required. The balancing between longer mixing time and higher temperature is essentially a trade-off. The preferred temperature is about 150° F. to 200° F., but this clearly can be varied. Additionally, mixing times at the preferred temperatures can be held to between about 8 and 10 minutes, which is very desirable since it allows large batch quantities of the fuel slurry to be made rather rapidly. Also, it is understood that with larger volumes, of fuel, the mixing time may go up slightly; however, certainly the prior art mixing times of 5 to 6 hours will not be required for preparing the composite fuel of the present invention. Even with batches many times greater than those set forth in the examples, the longest mixing time envisioned is in the order of 15 minutes to one-half hour.

The stabilized slurry can be used as a fuel in blast furnaces and is introduced into the blast furnaces through lances each of which is comprised of concentric pipes, with the inner pipe having an inner diameter of ⅜ inches and the outer pipe having a steam flow area of 0.1075 square inches. The desired flow rate for the slurry into the blast furnace is two gallons per minute with as many as ten lances being used to inject the slurry into the blast furnace, thereby resulting in 20 gallons per minute slurry flow into the blast furnace. It has been found that the preferred flow of 2 gallons per minute per lance can be accomplished with a pipe having a ⅜ inch internal diameter, using 60 pounds of pressure per square inch, provided that the fuel is maintained at about 150° F. Clearly, maintaining the fuel at a lower temperature will require a greater pressure to force the slurry through the lance since the slurry will be more viscous at the lower temperature and, also, if the internal diameter of the lance is smaller than a greater pressure will be required. Again, as previously discussed, these are trade-offs between the energy required to pump the slurry at a higher pressure and the energy required to heat the slurry to a higher temperature. When the slurry is injected into the blast furnace, the outer concentric pipe of the lance is used simultaneously to inject steam, thereby to atomize the slurry as it enters the blast furnace and to prevent build-up of slurry crust on the pipe opening. Since the emulsifiers used are carbohydrates, carbonization can occur at the nozzle opening and clog same. Carbonization is controlled by providing sufficient steam and maintaining the amount of emulsifier as low as possible while retaining the necessary stability.

The composition of the slurry may vary, as previously discussed, over a wide range; however, it is generally desired that the proportion of solid fuel be as high as possible without introducing unacceptable pumping problems and also that the proportion of water be as low as possible without compromising the stability of the slurry. As previously discussed, coal may be used up to about 65% by weight of the slurry without unacceptable loss of slurry flowability or pumpability. The lower limit for the solid fuel particles in the slurry is determined by the economics of preparing and pumping the slurry. Generally, preparing a slurry with less than about 25% by weight solid particles is uneconomical.

Account must be taken of the theoretical flame temperature when the slurry is burned as fuel in the blast furnace. When the slurry is introduced into the blast furnace, the water is converted into reducing gases that perform useful functions in cooler portions of the blast furnace, as well as aiding in the atomization of the slurry. Slurries containing between about 5% by weight and 15% by weight water are preferred; however, slurries containing up to 30% by weight water are useful in furnaces equipped for very high temperature air preheating or oxygen enriched air. If less than about 1% water is incorporated in the slurry, then emulsion is not formed and the slurry is not stable. Accordingly, the useful range of water or other non-oil in the slurry is between from about 1% by weight to about 30% by weight of the final slurry.

The amount of emulsifier used to produce the high external oil phase emulsion has been as low as 1/10% by weight. Since the emulsifiers heretofore used were extremely expensive and in fact, the most expensive ingredient per pound of the slurry, it was necessary to minimize the use of the emulsifier. On the other hand, one of the principle advantages of the present invention is the inexpensive nature of the preferred emulsifier described herein, dextrin, as well as the low cost of the other disclosed emulsifier, modified cellulose and modified starches. It is still desirable to maintain the concentration of emulsifier as low as possible since the polysaccharides disclosed herein which are applicable as emulsifiers may promote coking or caking in the injection lances when the slurry is used in a blast furnace. To reduce coking and caking of the lances, it is preferred that the emulsifier be present in the range of about 1 to 2% although smaller amounts of emulsifiers such as 1/20th or 1/50th of 1% may be used.

Although a limited number of emulsifiers have been disclosed, it is clear that other modified starches in addition to the pregelatinized corn starch and the copolymer specifically disclosed would be useful. For instance, a pregelatinized rice starch or other grain starch could be used in lieu of the specific corn starch disclosed. The preferred emulsifier is dextrin, while although a polysaccharide is not a starch, but doees have desirable properties for this particular invention. Dextrin when used as an emulsifier as disclosed in the present application has been compared to those emulsifiers disclosed in my co-pending patent application Ser. No. 591,312, filed June 30, 1975, by me and Victor D. Beaucaire. The emulsifiers disclosed in the prior application are much more expensive than dextrin while the dextrin slurry is more stable over longer periods of time. Accordingly, it is clear that dextrin is a significant advance in the art, since its critical performance is superior and it is cheaper to obtain and is more readily available.

While there has been described herein a preferred method for preparing a stabilized slurry, it will be understood that other modifications and alterations may be made without departing from the true spirit and scope of the present invention. It is intended that all such modifications and alterations be covered in the appended claims.

What is claimed is:

1. A method of preparing a stabilized fuel slurry having liquid fuel oil present in the range of from about 30% by weight to about 70% by weight, solid fuel particles with diameters as large as about ¼ inch percent in the range of from about 25% by weight to about 65% by weight, water present in the range of from about 1% by weight to about 30% by weight and an emulsifier selected from the class of polysaccharides consisting of modified starch, modified cellulose and dextrin capable of forming a water internal-high oil external phase emulsion present in the range of from about 0.1% by weight to about 10% by weight, said method comprising providing a liquid fuel oil, adding the emulsifier and solid fuel particles having diameters as large as two inches and water to the liquid fuel oil, and agitating the solid fuel particles in the liquid medium to form a water internal-oil high external phase emulsion and a stabilized fuel slurry having solid fuel particles with diameters no larger than about ¼ inch, wherein the majority of solid fuel particles are retained on a 70 mesh screen, the solid fuel particles staying substantially dispersed throughout the liquid medium for a extended period of time.

2. The method of preparing a stabilized fuel slurry set forth in claim 1, wherein the liquid fuel oil is present in the range of between about 30% by weight and about 50% by weight of the slurry.

3. The method of preparing a stabilized fuel slurry set forth in claim 1, wherein said solid fuel particles are present in the range of from about 50% by weight to about 65% by weight of the slurry.

4. The method of preparing a stabilized fuel slurry set forth in claim 1, wherein said solid fuel particles are comminuted by agitation until the largest of said particles is no larger than about ⅛ inch in diameter.

5. The method of preparing a stabilized fuel slurry set forth in claim 1, and further comprising maintaining the slurry at a temperature above about 100° F. during the mixing of the liquid fuel oil and the emulsifier and the solid fuel particles.

6. A method of preparing a stabilized fuel slurry having a liquid petroleum oil present in the range of from about 30% by weight to about 70% by weight, coal particles with diameters as large as about ¼ inch present in the range of from about 25% by weight to about 65% by weight, water present in the range of from about 1% by weight to about 30% by weight and an emulsifier of polysaccharides selected from the class consisting of modified starch, modified cellulose and dextrin capable of forming a water internal-oil high external phase emulsion present in the range of from about 1% by weight to about 5% by weight, said method comprising providing a liquid petroleum oil, adding the emulsifier and water to the petroleum oil, mixing the petroleum oil and emulsifier and the water for a period of at least about one minute to form the water internal-oil high external phase emulsion, adding coal particles with diameters as large as about 2 inches to the emulsion, and mechanically mixing the emulsion and the coal particles for a period of time in the range of from about ten minutes to about thirty minutes to comminute the coal particles and to form a stabilized slurry having coal particles with diameters no larger than about ¼ inch, wherein the majority of solid fuel particles are retained on a 70 mesh screen, the coal particles staying substantially dispersed throughout the liquid medium for a period of time in excess of about one month.

7. The method of preparing a stabilized fuel slurry set forth in claim 6, wherein the petroleum oil and the emulsifier and the water and the coal particles are maintained at a temperature of at least about 150° F. during the mixing thereof.

8. The method of preparing a stabilized fuel slurry set forth in claim 1, wherein the liquid fuel is selected from the class consisting of petroleum oil and coal tar and the solid fuel is selected from the class consisting of coal, coal by products and solid petroleum residuum.

9. The method of preparing a stabilized fuel slurry set forth in claim 1, wherein water is present in the stabilized fuel slurry in the range of between about 5% and about 15% by weight.

10. The method of preparing a stabilized fuel slurry set forth in claim 1, wherein the emulsifier is selected from the class consisting of pregelatinized corn starch, polyacrylonitrile-starch graft copolymer and methyl cellulose.

11. The method of preparing a stabilized fuel slurry set forth in claim 1, wherein the fuel slurry consists essentially of a liquid fuel oil, solid fuel particles, water and an emulsifier.

* * * * *